United States Patent [19]

Hampton

[11] 4,241,544

[45] Dec. 30, 1980

[54] SKATE BLADE SHARPENER

[76] Inventor: Joseph Hampton, R.R. 1, King, Ontario, Canada

[21] Appl. No.: 955,635

[22] Filed: Oct. 30, 1978

[51] Int. Cl.[3] ..... B24B 9/04

[52] U.S. Cl. ..... 51/33 R; 51/34 A; 76/83

[58] Field of Search ..... 51/31, 33 R, 34 A, 165.89, 51/228; 76/83; 409/85, 92, 121, 124

[56] References Cited

U.S. PATENT DOCUMENTS

| | | | |
|---|---|---|---|
| 3,164,932 | 1/1965 | Morith | 76/83 X |
| 3,597,880 | 8/1971 | Norgiel | 76/83 X |
| 3,719,006 | 3/1973 | Vezeau | 51/34 A |
| 3,735,533 | 5/1973 | Salberg | 51/228 X |
| 3,881,280 | 5/1975 | Thompson | 51/228 X |
| 3,889,424 | 6/1975 | Buhayar | 51/165.89 X |

*Primary Examiner*—Gary L. Smith
*Attorney, Agent, or Firm*—Sim & McBurney

[57] ABSTRACT

There is provided an apparatus for sharpening ice skates, which includes means for supporting the blade in a fixed location, and means for moving a rotating grinding member along the blade, with the grinding member rotating about an axis parallel with the plane of the blade. The guide means are provided to allow the grinding member to follow a predetermined profile. The guide means include a gearing arrangement which rotates a cam shaft as the carriage supporting the grinding member moves longitudinally of the blade. A pivotal arm supporting the grinding member has a cam follower which is raised or lowered by the cam surface, to cause the grinding member to follow the predetermined profile.

7 Claims, 7 Drawing Figures

SKATE BLADE SHARPENER

This invention relates generally to skate blade sharpeners, and has to do particularly with a device capable of sharpening a skate blade to a given, pre-determined profile.

SUMMARY OF THE PRIOR ART

The prior art includes a number of skate blade sharpening devices, in which a skate blade is clamped at one location, and a rotating stone is drawn along the blade, in order to give the blade the usual hollowed or concave configuration along the bottom. Two general arrangements are known, the first being that in which the plane of rotation of the stone is the same as the plane of the blade, the second being that in which the plane of rotation of the stone is transverse to the plane of the blade. Exemplary of the latter is U.S. Pat. No. 3,597,880, in which relative movement between a substantially conoidal stone and the edge of a skate blade is effected. The end configuration of the skate blade, however, is under the control of the operator, and thus some variance can be introduced in terms of the profile ground on a given skate at different times. For professional skaters, uncontrolled variations in the profile of their blades can be an annoyance. Many professional skaters prefer a specific profile, in particular a specific length of flat blade bottom, on either end of which is a specific proportion of upward curvature.

Another prior art representative is U.S. Pat. No. 3,164,932, Morith, dated Jan. 12, 1965 and entitled "Ice Skate Sharpener". Here again, the stone rotates in a plane transverse to the plane of the skate blade, and the operator moves the stone longitudinally with respect to the blade. However, there is no provision for repeatedly grinding precisely the same blade profile each time a given blade is ground.

SUMMARY OF THIS INVENTION

In view of the foregoing discussion of the prior art developments, it is an aspect of this invention to provide a skate blade sharpener adapted repeatedly to sharpen a skate blade to a given profile, and whereby the profile does not depend on uncontrolled variables such as hand-pressure and the like.

Accordingly, this invention provides a skate sharpening apparatus, comprising:

first means for firmly supporting a skate blade, a grinding member having the shape of a surface of revolution, power means for rotating the grinding member about its axis of symmetry, second means supporting the power means for pivoting movement about a pivotal axis transverse to said axis of symmetry, the pivotal axis being spaced from the grinding member, guide means for allowing relative translational movement between the first means and the second means, and cam means controlling the pivotal position of the power means as a function of the translational position of the first means relative to the second means, the cam means being such as to cause the grinding member to follow a locus corresponding to a predetermined skate blade profile.

GENERAL DESCRIPTION OF THE DRAWINGS

One embodiment of this invention is illustrated in the accompanying drawings, in which like numerals denote like parts throughout the several views, and in which.

Figures 1, 3, 4:
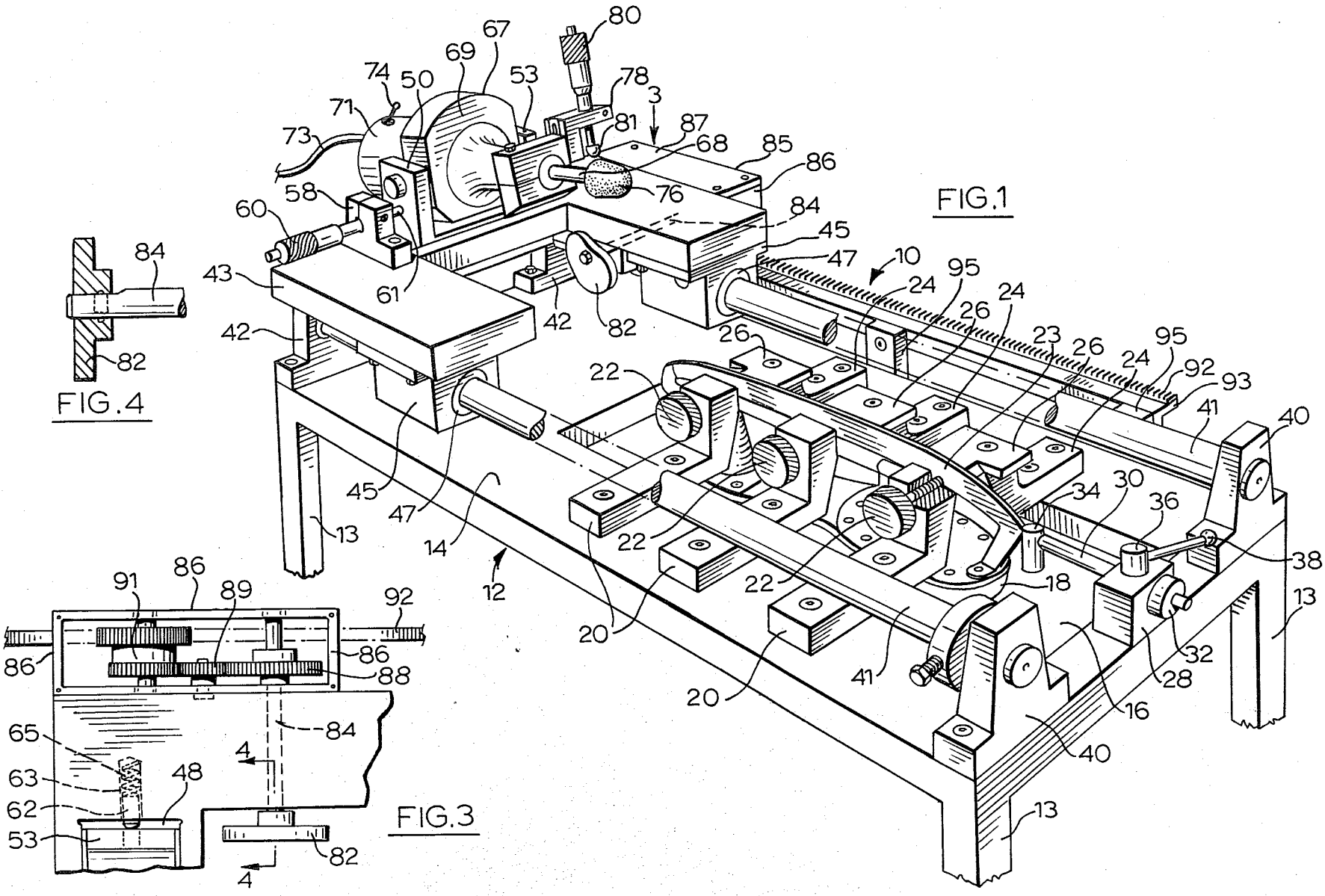
FIG. 1 is a partly broken-away perspective view of the apparatus of this invention before a blade sharpening sequence begins.
Figure 5:
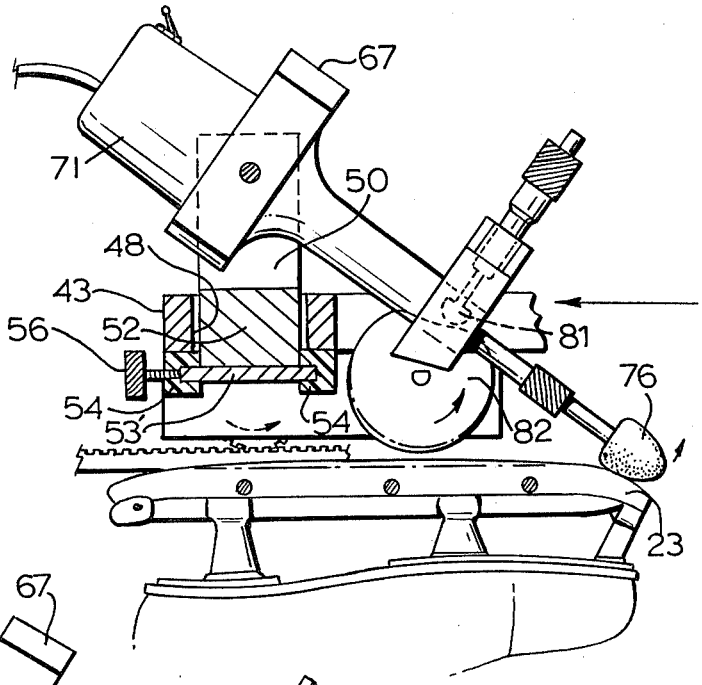
Figure 6:
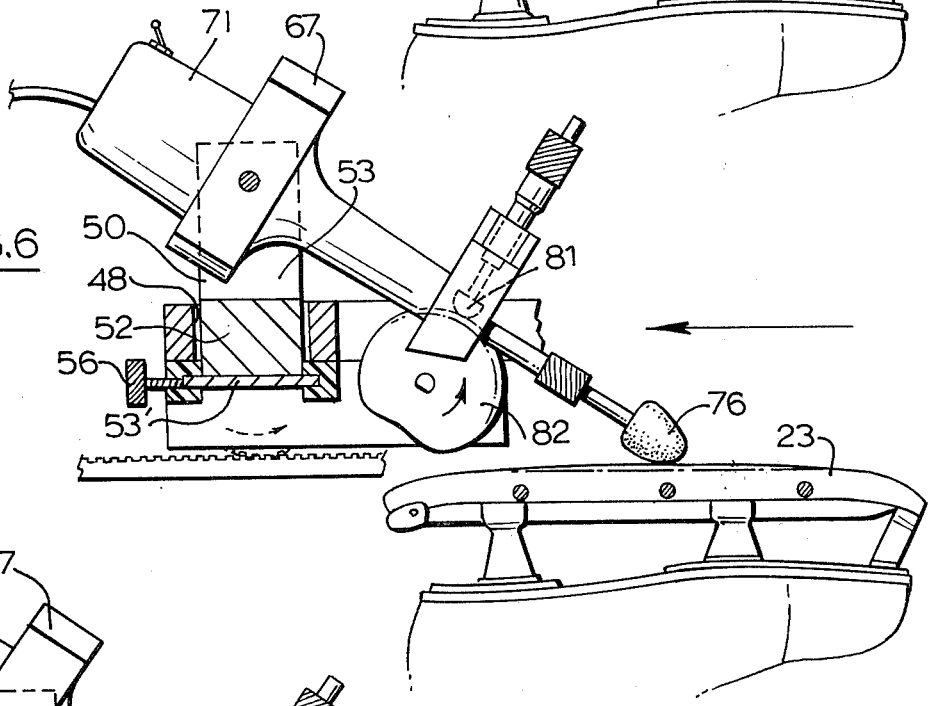
Figure 7:
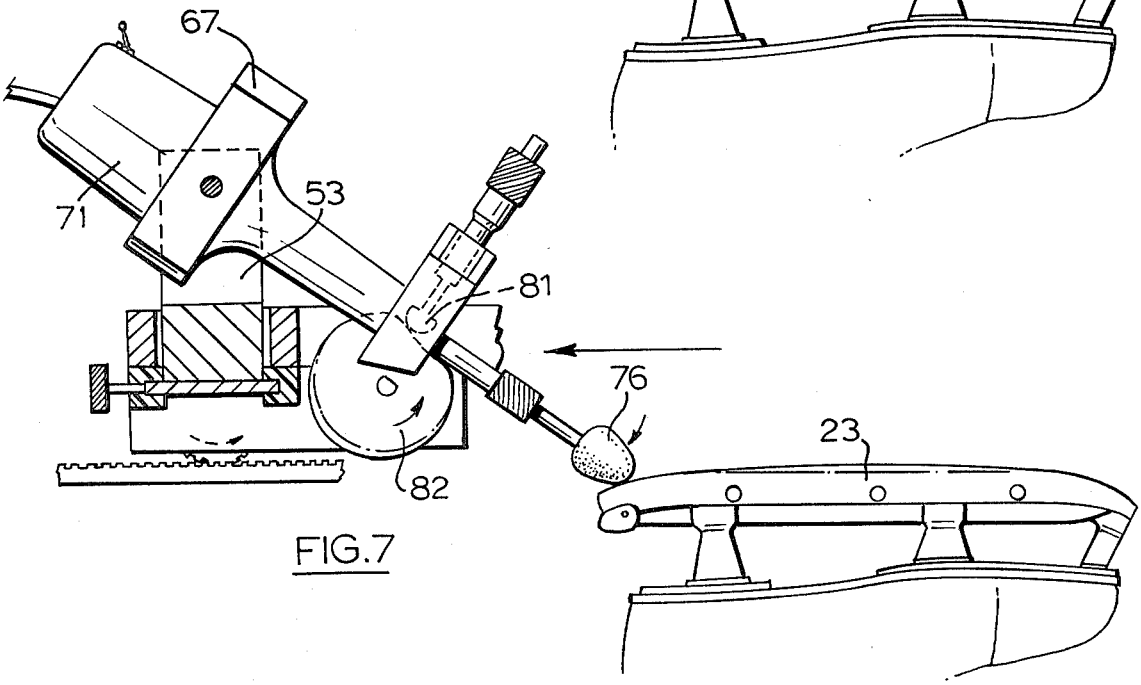

FIG. 3, on the same sheet as FIG. 1, illustrates gearing utilized in the apparatus of this invention;

FIG. 4, on the same sheet as FIG. 1, is a sectional view through a cam utilized with this invention; and FIGS. 5, 6 and 7 illustrate sequential steps in the sharpening of a skate blade in accordance with this invention.

PARTICULAR DESCRIPTION OF THE DRAWINGS

In FIG. 1, an apparatus shown generally at the numeral 10 is seen to include a base 12 supported on legs 13 and having an upper surface 14. The base 12 has a central rectangular opening 16 large enough to accommodate an ice skate 18. Mounted on the near side of opening 16 are three brace members 20 which support hand screws 22, the latter being adapted to bear against one side of the skate blade 23. Located opposite the brace members 20, on the far side of the opening 16, are three anvil members 24, each of which supports an anvil 26 in the form of a relatively flat, horizontal plate, the plates being adapted to bear against the far side of the blade 23 opposite the hand screws 22.

Mounted on the rightward end of the base 12 as seen in FIG. 1 is a block member 28 having a bore through which a rod 30 can slidably pass. An adjustment collar 32 is located on the rod 30 to the outside of the block member 28, and the rod 30 rigidly supports a short cylindrical member 34 at its other end. A set screw 36 with a handle 38 is threaded at right angles to the rod 30 through the block member 28, in order to lock the rod 30 into a given position. The portions just described constitute an adjustable toe stop which is used to set the longitudinal position of the skate blade 23 with respect to the members 22 and 24. Once the skate blade has been set into position and locked therein, the set screw 36 can be loosened and the rod 30 withdrawn to the right to take the cylindrical member 34 out of an adjacent position with respect to the skate blade 23.

Mounted at the extremities of the rightward end of the base 12 are two brackets 40 which support the rightward ends of two cylindrical slide bars 41. The other ends of the slide bars 41 are supported on similar brackets 42 at the opposite end of the base 12.

Slidably mounted for reciprocation along the slide bars 41 is a carriage 43, which includes two slide blocks 45 through which the slide bars 41 pass, the slide blocks having low-friction internal collar members 47 of known type.

The carriage 43 is in a C-configuration as seen from above, with the slide blocks 45 being secured to the end portions of the C. The mid portion of the C has an opening 48 therein, which is substantially rectangular and aligned with the mid portion of the "C"-shape.

Mounted for lateral adjustability within the opening 48 is a bracket 50 which includes a base portion 52 and two upstanding portions 53'. The base portion 52 has secured to its bottom a tracking plate 53 which is adapted to slide in longitudinal recesses provided in two guide members 54, the latter being affixed to the bottom of the mid portion of the C-shaped carriage 43, on either side of the recess 48. A manual set screw 56 through one of the guide members 54 is adapted to lock the tracking plate 53 in place, when the same has been adjusted to the required location.

Figure 2:
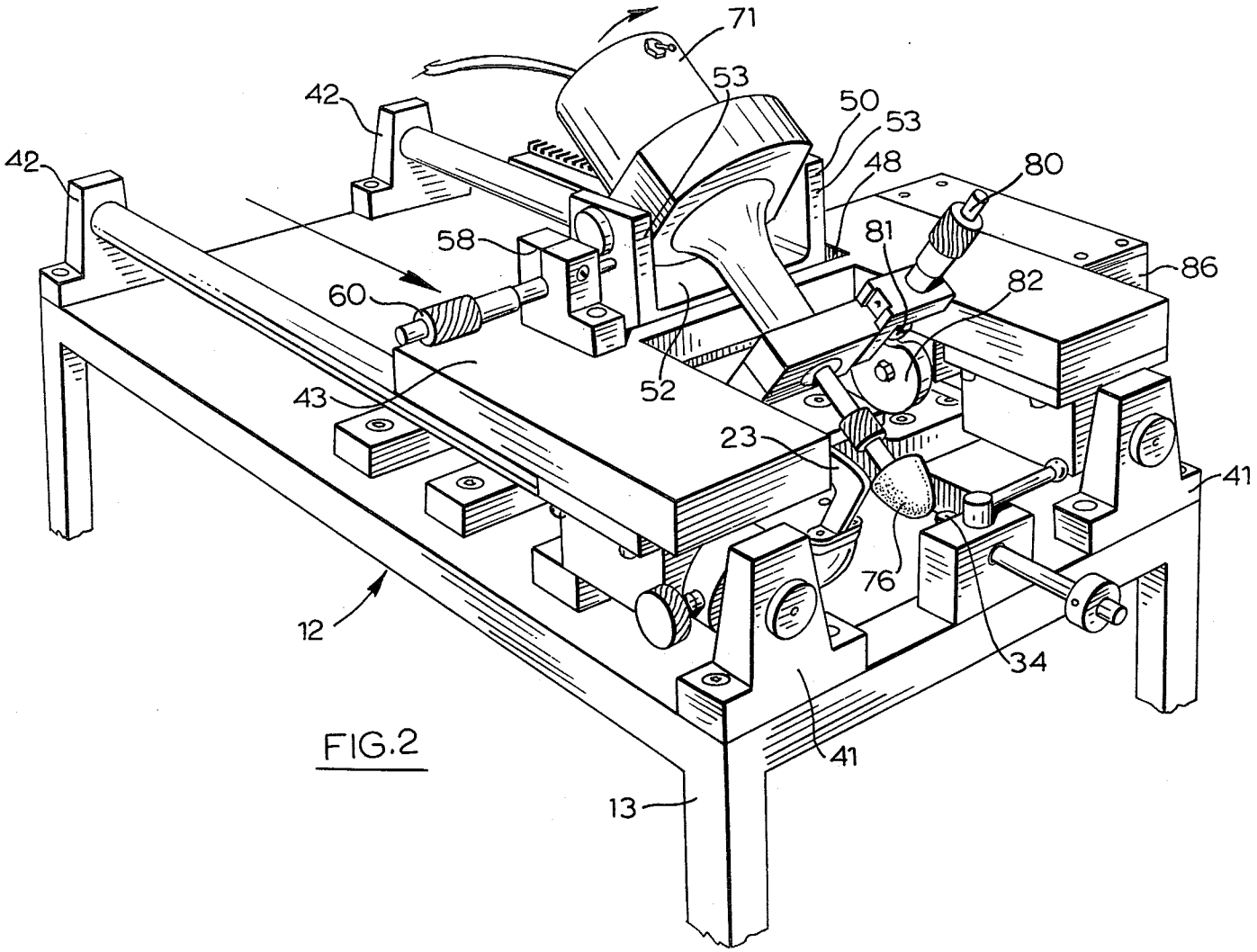
FIG. 2 is a view similar to that of FIG. 1, just prior to the initiation of the blade sharpening procedure.

As seen in FIGS. 1 and 2, a bracket 58 is provided on the nearer or leftward end portion of the C-shaped carriage 43, adjacent the opening 48, through which bracket a threaded micrometer member 60 passes. The end 61 of the micrometer member 60 bears against the nearer upstanding member 53', such that adjustment of the micrometer member 60 is able to push against the bracket 50 and adjust its position. In order to keep the bracket 50 bearing against the micrometer member 60, a probe 62 (see FIG. 3) is provided in a suitable bore 63, and is spring biased toward the micrometer member 60 by a coil spring 65.

Mounted within bracket 50 for pivotal motion about an axis transverse to the long dimension of the slide bars 41, is a high speed rotary device 67 having a rotational shaft 68, a mounting flange 69 and a motor housing 71. An electrical cord 73 supplies electrical power, and an on/off switch 74 is also provided. A grinding member 76 is mounted on the end of the shaft 68, and is adapted to be rotated thereby.

A bracket 78 is fixed with respect to the rotary device 67 at a location spaced from the grinding member 76, and has a fine-adjustment micrometer 80 passing therethrough, on the end of which is located a cam follower 81.

The cam follower 81 is adapted to bear against a cam 82 mounted on a cam shaft 84 which passes through the further end portion of the C-shaped carriage 43 as seen in FIG. 1, in a horizontal direction transverse to the major dimension of the slide bars 41.

Affixed to the far side of the further main portion of the C-shaped carriage 43 is a gear box 85 which includes side walls 86 and a top 87, the top being removed in FIG. 3 in order to illustrate the gearing within the gear box 85. Fixed to the cam shaft 84 is a first gear 88, meshing with an idler 89, which in turn meshes with the smaller of two integral gears which form a compound gear 91. The larger of the gears forming the compound gear 91 is the pinion of a rack-and-pinion mechanism, for which the rack is shown at 92 in FIG. 1. The rack 92 is mounted on an angle bar 93 supported from the base 12 on brackets 95.

The rack 92 is mounted at such a height that, as the carriage 43 reciprocates along the slide bars 41, the larger of the gears forming the compound gear 91 meshes with the rack 92, alternately causing the cam shaft 84 to rotate, and thus also causing the cam 82 to rotate.

The cam 82 is snap-mounted to the shaft 84 through a non-circular fit, as illustrated in FIG. 4. This means that the cam can be replaced by other cams of slightly different configurations, in order to alter the profile which is ground onto a skate blade fixed into the apparatus.

Attention is now directed to FIGS. 2, 5, 6 and 7 for a description of the operation of the device herein disclosed.

In FIG. 2, the carriage 43 has been brought forward to a position in which the grinding member 76 is beyond the toe portion of the blade 23. The arrangement is such that, in the position shown in FIG. 2, the grinding member 76 is at its lowest position, due to the fact that the cam follower 81 is in the least-radius portion of the cam 82. It will be seen particularly in FIG. 5 that the cam 82 has a least-radius portion covering about 80° of arc, and that the remainder of the cam is almost circular, with a slightly increased radius opposite the least-radius portion. In FIG. 5, the chain-dotted line on the cam is a true circle, from which it can be seen that the actual cam profile is raised from that of a true circle over the region opposite the least-radius portion.

It will also be seen in FIG. 2 that the toe stop mechanism which includes the solid cylinder 34 has been withdrawn to the right out of the way of the grinding member 76. Prior to removing the toe-stop, the same would have been placed in its furthest inward position, in order to locate the skate blade 23 properly with respect to the remainder of the apparatus.

Looking at FIG. 5, the carriage has now been brought gradually to the rear or leftwardly a slight distance, and the grinding member 76 has begun to grind the skate blade 23 near the toe end thereof. At the same time, the cam follower 81 is riding upwardly out of the least-radius portion, toward the near-circular portion of the cam 82.

Further motion to the left as seen in FIG. 6 brings the cam follower 81 to the largest diameter portion of the cam 82, and it is along this portion that the centre part of the skate blade 23 is ground by the grinding member 76.

In FIG. 7, the cam wheel has rotated to bring the cam follower 81 just into the beginning of the least-radius portion, and it is at this location that the grinding member 76 is following the greater curvature at the heel end of the blade 23 of the skate.

It will be understood that the purpose of the reduction gearing utilized in the gear box 85 is to permit use of a cam of which the circumference need not be the same length as the length of the skate blade. By gearing down the rotation imparted to the "pinion" part of a compound gear 91, this smaller size of cam is permitted.

Having described the actual working of the mechanism during a grinding procedure, it is appropriate to discuss the practical aspects of utilizing this apparatus, and the steps that need to be followed.

Firstly, a skate is pushed up from underneath and clamped by the three manual hand screws 22. Before clamping, the toe stop is put into position and tightened with the set screw 36.

An ink patch may then be applied at the centre of the blade, and the grinding member 76 can be brought down and rotated by hand at the ink patch, in order visually to find the centre of the blade. The centre of the blade (zero position) can also be established by a micrometer reading on member 60 which would be established relative to the blade thickness.

A skate may be sharpened with a high inside edge or parallel edges to suit the individual skater's preference and this can be established by adjusting the micrometer member 60 to a precision offset setting from the zero position (centre line of blade).

The cam 82 for the particular blade is then affixed to the cam shaft 84, and snapped into place.

The operator would then move the carriage by hand with the grinding member 76 lightly pressed against the blade to determine whether the grinding member closely follows the blade contour, as the cam rotates. If the grinding member leaves the blade during this run, it would be necessary to lower the entire trajectory of the grinding member 76 by adjusting the micrometer 80.

The operator would then switch on the rotary device 67, and proceed to grind the skate blade 23 in the manner already described.

I claim:

1. A skate sharpening apparatus, comprising:

first means for firmly supporting a skate blade, a grinding member having the shape of a surface of revolution, power means for rotating the grinding member about its axis of symmetry, second means supporting the power means for pivoting movement about a pivotal axis transverse to said axis of symmetry, the pivotal axis being spaced from the grinding member, guide means for allowing relative translational movement between the first means and the second means, and cam means controlling the pivotal position of the power means as a function of the translational position of the first means relative to the second means, the cam means being such as to cause the grinding member to follow a locus corresponding to a predetermined skate blade profile, said cam means including a gear rack fixed with respect to said first means, a pinion meshing with and rolling on said rack, the pinion axis being transverse to the direction of translational movement and being fixed with respect to said second means; and means including a reduction gear mechanism for applying the rotation of said pinion to a cam shaft whose axis is fixed with respect to the second means whereby the cam shaft rotates more slowly than the pinion, a cam on said cam shaft, a follower mounted on the power means and bearing against the cam, the cam being contoured such that the follower causes the grinding member to follow the profile of a skate blade supported in said first means.

2. The apparatus claimed in claim 1, in which said second means includes manual fine-adjustment means for adjusting the lateral position of the grinding member with respect to the second means, in order to center the same with respect to the skate blade.

3. The apparatus claimed in claim 1, in which the power means is slidable laterally with respect to the second means, in which a screw-threaded member urges the power means in one direction laterally when turned in a given rotational sense, and in which biasing means urges the power means against said screw-threaded member, whereby the lateral position of said power means can be adjusted with respect to said second means, and thus with respect to said skate blade.

4. The apparatus claimed in claim 1, in which said follower is adjustable with respect to the power means, whereby the trajectory followed by the grinding member for a given cam can be altered.

5. The apparatus claimed in claim 1, claim 2 or claim 4, in which said guide means includes cylindrical slide bars fixed to the first means, upon which the second means is mounted for sliding movement.

6. The apparatus claimed in claim 1, claim 2 or claim 4, in which the cam is replaceably snap-mounted on said cam shaft.

7. The apparatus claimed in claim 1, claim 2 or claim 4, in which there is also provided a removable toe stop against which a skate blade can abut in order to set the longitudinal position of the skate blade with respect to the first means, thereby to match the skate profile to the grinding member trajectory.

* * * * *